United States Patent [19]

Zaczepinski et al.

[11] 4,448,665

[45] May 15, 1984

[54] USE OF AMMONIA TO REDUCE THE VISCOSITY OF BOTTOMS STREAMS PRODUCED IN HYDROCONVERSION PROCESSES

[75] Inventors: Sioma Zaczepinski; Rustom M. Billimoria, both of Houston; Frank Tao, Baytown; Christopher G. Lington, Houston; Karl W. Plumlee, Baytown, all of Tex.

[73] Assignee: Exxon Research and Engineering Co., Florham Park, N.J.

[21] Appl. No.: 454,804

[22] Filed: Dec. 30, 1982

[51] Int. Cl.[3] ..... C10G 1/00; C10G 1/06; C10G 47/00; C10C 1/18

[52] U.S. Cl. ..... 208/8 LE; 208/10; 208/45; 208/107; 208/112

[58] Field of Search ..... 208/8 LE, 10, 107, 112, 208/45

[56] References Cited

U.S. PATENT DOCUMENTS

| | | | |
|---|---|---|---|
| T700,485 | 4/1969 | Hemminger et al. | 208/8 LE |
| 2,133,280 | 10/1938 | Burk | 208/8 LE |
| 2,286,823 | 6/1942 | McMillan | 208/45 X |
| 2,365,029 | 12/1944 | Voorhies, Jr. | 208/112 X |
| 3,389,714 | 6/1968 | Hughes et al. . | |
| 3,558,468 | 1/1971 | Wise | 208/8 LE |
| 3,618,624 | 11/1971 | Vairogs . | |
| 3,711,399 | 1/1973 | Ester et al. | 208/112 |
| 3,794,580 | 2/1974 | Ladeur | 208/112 X |
| 3,808,119 | 4/1974 | Bull et al. | 208/8 LE |
| 3,855,114 | 12/1974 | Green et al. | 208/112 X |
| 4,188,193 | 2/1980 | Felbeck | 208/10 X |
| 4,228,002 | 10/1980 | Kenbohoron et al. | 208/8 LE X |
| 4,322,283 | 3/1982 | Maa et al. | 208/8 LE X |

*Primary Examiner*—Delbert E. Gantz
*Assistant Examiner*—William G. Wright
*Attorney, Agent, or Firm*—Yale S. Finkle

[57] ABSTRACT

Coal, petroleum residuum and similar carbonaceous feed materials are subjected to hydroconversion in the presence of molecular hydrogen to produce a hydroconversion effluent which is then subjected to one or more separation steps to remove lower molecular weight liquids and produce a heavy bottoms stream containing high molecular weight liquids and unconverted carbonaceous material. The viscosity of the bottoms streams produced in the separation step or steps is prevented from increasing rapidly by treating the feed to the separation step or steps with ammonia gas prior to or during the separation step or steps. The viscosity of the heavy bottoms stream produced in the final separation step is also controlled by treating these bottoms with ammonia gas. In a preferred embodiment of the invention, the effluent from the hydroconversion reactor is subjected to an atmospheric distillation followed by a vacuum distillation and the feeds to these distillations are contacted with ammonia during the distillations.

21 Claims, 3 Drawing Figures

FIGURE I

USE OF AMMONIA TO REDUCE THE VISCOSITY OF BOTTOMS STREAMS PRODUCED IN HYDROCONVERSION PROCESSES

The government of the United States of America has rights in this invention pursuant to Cooperative Agreement No.DE-FCO1-77-ET10069 (formerly Contract No. EF-77-A-01-2893) awarded by the U.S. Energy Research and Development Administration, now the U.S. Department of Energy.

BACKGROUND OF THE INVENTION

This invention relates to the hydroconversion of carbonaceous materials such as coal and petroleum residua and is particularly concerned with a method for decreasing and controlling the viscosity of the high molecular weight bottoms streams produced in such hydroconversion processes.

Processes for the hydroconversion or liquefaction of coal and similar carbonaceous solids normally require contacting of the solid feed material with a hydrocarbon solvent and molecular hydrogen at elevated temperature and pressure to break down the complex high molecular weight starting material into lower molecular weight hydrocarbon liquids and gases. One of the most promising processes of this type is carried out with a hydrogen-donor solvent, which gives up hydrogen atoms in reaction with organic radicals liberated from coal or other feed material during the hydroconversion or liquefaction step. Within the hydroconversion or liquefaction zone, the high molecular weight constituents of the coal are cracked and hydrogenated to form lower molecular weight vapors and liquid products. The effluent from the liquefaction reactor is then separated into gases, relatively low molecular weight liquids and one or more bottoms stream containing higher molecular weight liquids, unconverted carbonaceous material and mineral matter.

The viscosity of the bottoms streams produced in coal hydroconversion or liquefaction processes tends to be relatively high because the bottoms streams are composed of high molecular weight constituents and mineral matter. In order to pump the bottoms streams produced by subjecting the liquefaction zone effluent to one or more separation steps, the viscosity of the bottoms streams must be maintained below an upper limit of about 150 poise. As conversion in the liquefaction zone increases, the organic content of the bottoms decreases and the mineral matter content increases. Since the contribution to viscosity of the inorganic or mineral matter fraction in the bottoms will increase as conversion in the liquefaction zone increases, it is necessary to decrease the viscosity contribution of the organic fraction in order to maintain the overall viscosity of the bottoms at a relatively low value. A decrease in the viscosity contribution of the organic portion of the bottoms will in turn allow conversion in the liquefaction zone to be carried out to a greater degree thus increasing the amount of desirable products and decreasing the amount of high molecular weight bottoms constituents.

Unlike the bottoms streams produced in coal hydroconversion or liquefaction processes, the bottoms streams produced in petroleum residuum hydroconversion processes will contain little, if any, mineral matter. These bottoms streams will, however, contain high molecular weight liquids and unconverted carbonaceous material and will therefore tend to have relatively high viscosities. Thus, it may be desirable in some residuum hydroconversion processes to have the capability of controlling the viscosities of the bottoms streams so that they can be maintained below desired values.

In coal and residuum hydroconversion processes wherein high molecular weight bottoms streams are produced, the bottoms will contain a relatively large amount of organic material that must be utilized in some way to make the overall process economical. The bottoms could be burned to generate heat, subjected to gasification to produce hydrocarbon gases or submitted to other conversion processes. In some instances it is necessary to store the bottoms prior to their subsequent processing. This storage is normally done at elevated temperatures to keep the bottoms in a molten state and it has been found that during such storage, the bottoms viscosity may tend to increase to unacceptably high values. Methods to prevent this viscosity increase are needed in order to ensure that the bottoms can be pumped to subsequent downstream units for further processing.

SUMMARY OF THE INVENTION

The present invention provides an improved process for the hydroconversion of coal, petroleum residuum and similar carbonaceous feed material in which lower molecular weight liquid hydrocarbons and high molecular weight bottoms streams are produced and the viscosity of the bottoms streams is reduced and controlled. In accordance with the invention, it has now been found that the viscosity of the heavy bottoms streams produced by subjecting the hydroconversion effluent to one or more separation steps to remove lower molecular weight liquids can be reduced and controlled by treating the feed stream to the separation step or steps at a temperature above about 300° F. with added ammonia gas prior to or during the separation step or steps. If more than one separation step is utilized in processing the hydroconversion zone effluent, the stream exiting one separation step can be treated with gaseous ammonia prior to or during the next separation step. It has also been found that the bottoms stream exiting the last separation step can be treated with ammonia gas in order to prevent its viscosity from increasing prior to subjecting the bottoms to a subsequent processing step. In all cases after the bottoms stream has been treated with the ammonia gas, it will be transported to the next step of the process in the substantial absence of ammonia.

The term "hydroconversion" as used herein with reference to coal or other carbonaceous solids refers to the liquefaction of such solids or their conversion into lower molecular weight constituents in the presence of molecular hydrogen. The term "hydroconversion" as used herein with reference to residua, other petroleum feeds, and similar carbonaceous materials refers to a process carried out in the presence of molecular hydrogen in which at least a portion of the heavy constituents of the feed is converted to lower molecular weight hydrocarbonaceous materials.

In a preferred embodiment of the invention, the hydroconversion zone effluent is first subjected to an atmospheric fractionation to produce a heavy bottoms stream boiling above about 700° F. which, in turn, is subjected to a vacuum distillation step to produce a heavy bottoms stream boiling above a temperature in the range between about 850° F. and about 1000° F. The gaseous ammonia is introduced into the bottom of each of the fractionating or distillation towers and the bottoms stream exiting the vacuum distillation column is blanketed with ammonia prior to subsequent processing. It is believed that during distillation the added ammonia gas interacts with acidic organic groups, such as phenols, in the streams fed to these distillation towers, thereby preventing or minimizing condensation and polymerization reactions that normally take place and result in increased viscosity at high temperatures.

The process of the invention enables the viscosity of bottoms streams produced during the hydroconversion of coal, petroleum residuum and similar carbonaceous feed materials to be controlled such that, if desirable, greater conversions of feed can be obtained during hydroconversion, and higher yields of oils can be obtained from fractionation of the hydroconversion effluent without detrimentally affecting the pumpability of the bottoms streams. The increase in both conversions and production of liquids results in more efficient utilization of the organic material in the carbonaceous feed and therefore a more efficient process.

DESCRIPTION OF THE PREFERRED EMBODIMENTS

Figure 1:
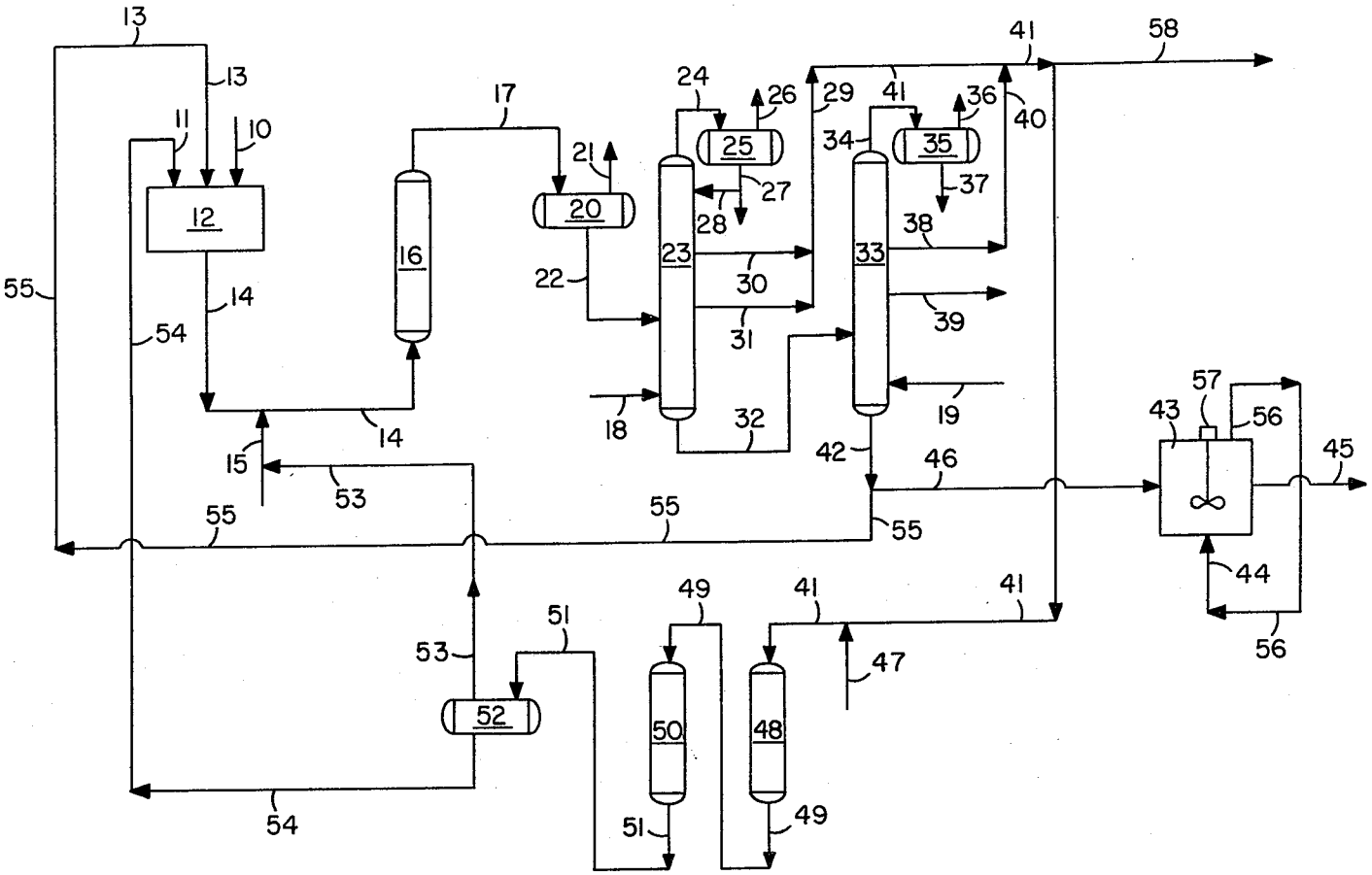
FIG. 1 in the drawing is a schematic flow diagram of a coal hydroconversion or liquefaction process illustrating a preferred embodiment of the invention.

The process depicted in FIG. 1 is a preferred embodiment of the invention in which bituminous coal, subbituminous coal, lignitic coal or similar solid carbonaceous feed material is first hydroconverted or liquefied by contacting the solids with molecular hydrogen in the presence of a hydrocarbon solvent. Gases are separated from the liquefaction product and the remaining material is then subjected to an atmospheric fractionation followed by a vacuum fractionation to produce liquids normally boiling up to a temperature in the range between about 850° F. and about 1000° F. and a heavy bottoms product normally boiling in excess of that temperature. Ammonia gas is introduced into the bottom of the atmospheric fractionator and the vacuum fractionator in order to lower and control the viscosity of the bottoms stream produced in the fractionator. A portion of the combined liquid streams produced in the fractionators is hydrogenated and recycled for use as solvent and the remaining liquids are withdrawn as product. The heavy bottoms are then stored in an atmosphere of gaseous ammonia in order to prevent polymerization and degradation prior to further processing. It will be understood that the process of the invention is not restricted to the use of ammonia gas in both an atmospheric fractionator and a vacuum fractionator or in the storage of the bottoms from the vacuum fractionator. For example, the ammonia gas can be used to treat the feed stream to each fractionator instead of being used in the fractionator itself, it can be used in only one of the fractionators or it can be used only to blanket the heavy bottoms produced from either of the fractionators during storage. Furthermore, it will be understood that the process of the invention is not limited to use in the system depicted in FIG. 1. To the contrary, the invention may be employed in any hydroconversion process in which the effluent from the hydroconversion zone is subjected to one or more separations to produce a heavier product and gaseous ammonia is used to treat the feed to the separation step or steps prior to or during the separation, or to treat the bottoms from one or more of the separation steps during high temperature storage.

In the process depicted in FIG. 1, coal or similar solid, carbonaceous feed material is introduced into the system through line 10 from a coal storage or feed preparation zone, not shown in the drawing, and combined with a hydrocarbon solvent, preferably a hydrogen-donor solvent, introduced through line 11 and partially liquefied coal or recycle liquefaction bottoms introduced through line 13 to form a slurry in slurry preparation zone 12. The feed material employed will normally consist of solid particles of bituminous coal, subbituminous coal, lignitic coal, brown coal or a mixture of two or more such materials. In lieu of coal, other solid carbonaceous materials may be introduced into the slurry preparation zone as feed. Such materials include organic waste, oil shale, liquefaction bottoms and the like. The particle size of the feed material may be on the order of about ¼ inch or smaller along the major dimension, but it is generally preferred to use feed solids which have been crushed and screened to a particle size of about 8 mesh or smaller on the U.S. Sieve Series Scale. It is also generally preferred to dry the feed particles to remove excess water, either by conventional techniques before the solids are mixed with the solvent in the slurry preparation zone or by mixing wet solids with hot solvent at a temperature above the boiling point of water, preferably between about 250° F. and about 350° F., to vaporize the water in the preparation zone. The moisture in the feed slurry is preferably reduced to less than about 4.0 weight percent.

The hydrocarbon solvent used to prepare the slurry in slurry preparation zone 12 is preferably a hydrogen-donor solvent which contains at least 1.2 weight percent donatable hydrogen, based on the weight of the solvent. In some cases, a nonhydrogen-donor diluent containing less than about 1.2 weight percent donatable hydrogen may be used. Regardless of whether a hydrogen-donor or nonhydrogen-donor solvent is employed, it may also be desirable to utilize a hydroconversion catalyst. The preferred hydrogen-donor solvent will be a process derived solvent, preferably a hydrogenated recycle solvent, containing between about 1.2 and about 3.0 weight percent donatable hydrogen. The hydrogen donor diluent will normally contain at least 20 weight percent of compounds that are recognized as hydrogen donors at elevated temperatures generally employed in coal liquefaction reactors. Representative compounds of this type include $C_{10}$–$C_{12}$ tetrahydronaphthalenes, $C_{12}$–$C_{16}$ acenaphthenes, di, tetra, and octahydroanthracenes, tetrahydroacenaphthenes, and other derivatives of partially hydrogenated aromatic compounds. Such hydrogen-donor solvents have been described in the literature and therefore will be familiar to those skilled in the art. The solvent composition resulting from hydrogenating a recycle solvent fraction will depend in part upon the particular coal or other carbonaceous solids used as the feedstock to the process, the process steps and operating conditions employed and the conditions used in hydrogenating the solvent fractions selected for recycle following liquefaction. Normally, sufficient solvent is introduced into slurry preparation zone 12 to provide a weight ratio of solvent to carbonaceous feed solids between about 0.4:1 and about 4:1, preferably from about 1.0:1 to about 1.8:1. Other ratios may be required if the recycle rate of liquefaction bottoms introduced into the preparation zone through line 13 is relatively high.

The slurry formed in slurry preparation zone 12 is withdrawn from the zone through line 14; mixed with a hydrogen-containing gas, preferably molecular hydrogen, introduced into line 14 via line 15; preheated to a temperature above about 670° F.; and passed upwardly in plug flow through hydroconversion or liquefaction reactor 16. The mixture of slurry and hydrogen-containing gas will contain from about 3 to about 10 weight percent, preferably from about 4 to about 8 weight percent, hydrogen on a moisture free solids basis. The liquefaction reactor is maintained at a temperature between about 700° F. and about 900° F., preferably between about 800° F. and about 880° F., and at a pressure between about 300 psig and about 3000 psig, preferably between about 1500 psig and about 2500 psig. Although a single liquefaction reactor is shown in the drawing as comprising the liquefaction zone, a plurality of reactors arranged in parallel or series can also be used, provided that the temperature and pressure in each reactor remain approximately the same. Such will be the case if it is desirable to approximate a plug flow situation. The nominal slurry residence time within reactor 16 will normally range between about 15 minutes and about 150 minutes, preferably between about 40 minutes and about 90 minutes.

Within the hydroconversion or liquefaction zone in reactor 16, the carbonaceous feed solids undergo liquefaction or chemical conversion into lower molecular weight constituents. The high molecular weight constituents of the feed solids are broken down and hydrogenated to form lower molecular weight gases and liquids. The hydrogen-donor solvent molecules react with organic radicals liberated from the carbonaceous feed solids to stabilize them and thereby prevent their recombination. The hydrogen in the gas introduced into line 14 via line 15 serves at least in part to stabilize organic radicals generated by the cracking of complex molecules. This hydrogen also serves as replacement hydrogen for depleted hydrogen-donor molecules in the solvent and its presence results in the formation of additional hydrogen-donor molecules by in-situ hydrogenation to convert aromatics into hydroaromatics.

The effluent from liquefaction reactor 16, which contains gaseous liquefaction products such as carbon dioxide, carbon monoxide, ammonia, hydrogen sulfide, methane, ethane, ethylene, propane, propylene and the like; unreacted hydrogen from the feed slurry; light liquids; and heavier liquefaction products including mineral matter, unconverted carbonaceous solids and high molecular weight liquids is withdrawn from the top of the reactor through line 17 and passed to separator 20. Here the reactor effluent is separated, into an overhead vapor stream which is withdrawn through line 21 and a slurry stream removed through line 22. The overhead vapor stream is passed to downstream units where the ammonia, hydrogen and acid gases are separated from the low molecular weight gaseous hydrocarbons, which are recovered as valuable byproducts or used as fuel. The hydrogen recovered from treating the overhead vapor stream can be reused in the process by recycling to line 15.

The slurry stream removed from separator 20 through line 22 will normally contain low molecular weight liquids, high molecular weight liquids, mineral matter or ash in an amount between about 5 and about 30 weight percent, and unconverted carbonaceous solids. This stream is passed through line 22 into atmospheric distillation tower 23 where the separation of low molecular weight liquids from high molecular weight liquids boiling above a temperature in the range between about 850° F. and about 1000° F. and solids is begun. In the atmospheric distillation column, the feed is fractionated in the presence of gaseous ammonia introduced into the bottom of the fractionator through line 18. The added ammonia gas contacts the heavy material in the bottom of the column at a temperature between about 500° F. and about 700° F. Sufficient ammonia gas is introduced into the distillation tower such that the weight ratio of gas to feed ranges between about 0.01 and about 0.6. An overhead fraction composed primarily of gases and naphtha constituents boiling up to about 350° F. is withdrawn from atmospheric distillation column 23 through line 24, cooled and passed to distillate drum 25 where the gases are taken off overhead through line 26. This stream will normally be treated to recover the ammonia that was introduced into the bottom of the distillation column through line 18 for recycle to the distillation column. The remainder of the gases may be employed as a fuel gas for generation of process steam, steam reformed to produce hydrogen that may be recycled to the process where needed, or used for other purposes. Liquids are withdrawn from distillate drum 25 through line 27 and a portion of the liquids may be returned as reflux through line 28 to the upper portion of the distillation column. The remaining naphtha is normally recovered as product.

One or more intermediate fractions boiling within the range from about 350° F. to about 700° F. are recovered from distillation column 23 as product or for use as feed to the solvent hydrogenation unit, which is described in detail hereinafter. It is generally preferred to withdraw a relatively light fraction composed primarily of constituents boiling below about 500° F. through line 30 and to withdraw a heavier intermediate fraction composed primarily of constituents boiling below about 700° F. through line 31. These two distillate fraction are passed though line 29 into line 41. The bottoms from the distillation column, composed primarily of constituents boiling in excess of about 700° F., is withdrawn through line 32, heated to a temperature between about 600° F. and 775° F., and introduced into vacuum distillation column 33. This bottoms stream will normally contain between about 40 and about 90 weight percent high molecular liquids, between about 5 and about 50 weight percent mineral matter or ash and between about 5 and about 50 weight percent unconverted carbonaceous solids. The bottoms stream withdrawn from atmospheric distillation column 23 will normally contain essentially no absorbed ammonia and is passed in the substantial absence of ammonia gas to the vacuum distillation tower.

In the vacuum distillation column, the feed is distilled under reduced pressure in the presence of gaseous ammonia introduced into the bottom of the distillation column through line 19. The added ammonia contacts the heavy material in the bottom of the distillation column at a temperature between about 500° F. and about 700° F. An overhead fraction is withdrawn from the vacuum distillation column through line 34, cooled and passed into distillate drum 35. Gases are removed from the distillate drum via line 36 and are normally treated to recover the ammonia introduced into the distillation column through line 19 for recycle to the column. Once the ammonia is recovered, the remainder of the gases may be used as fuel, passed through a steam reformer to produce hydrogen for recycling to the process where needed, or used for other purposes. Light liquids are withdrawn from the distillate drum as product through line 37. A heavier intermediate fraction, composed primarily of constituents boiling below about 850° F., may be withdrawn from the vacuum distillation tower through line 38 and passed through line 40 into line 41. A still heavier sidestream may be withdrawn through line 39 and recovered as product. The bottoms from the vacuum distillation column, which consists of between about 2 weight percent and about 20 weight percent high molecular weight liquids boiling above a temperature in the range between about 850° F. and about 1000° F., between about 5 and about 50 weight percent unconverted carbonaceous solids, and between about 5 and about 50 weight percent mineral matter or ash, is withdrawn through line 42. This heavy liquefaction bottoms product contains a substantial amount of organic material and is passed through line 46 into storage tank 43 to await further processing to convert this organic material into liquids and/or gases. A portion of this heavy bottoms stream, normally between about 20 and about 80 weight percent of the stream, is recycled to slurry preparation zone 12 through lines 55 and 13. The bottoms stream withdrawn from vacuum distillation tower 33 will normally contain essentially no absorbed ammonia and is passed to storage or to the slurry preparation zone in the substantial absence of ammonia gas.

The bottoms withdrawn from atmospheric distillation column 23 through line 32 and the bottoms withdrawn from vacuum distillation column 33 through line 42 will contain mineral matter, unconverted carbonaceous solids and high molecular weight liquids. Because of the heavy materials which comprise these streams, their viscosities will normally be relatively high and therefore the streams will be difficult to pump. Normally, it is desirable to maintain the upper limit of the viscosities of these streams below between about 100 poise and about 150 poise in order to ensure their pumpability. Unfortunately, it is sometimes difficult to achieve this goal since the heavy constituents that comprise the bottoms are subjected to high temperatures in the distillation columns and therefore tend to condense or polymerize to form more viscous organic materials. It has now been found that the viscosities of these bottoms streams can be controlled by treating the feed to the distillation columns at a temperature above about 300° F. with ammonia gas prior to or during distillation. It is believed that the ammonia reacts with acidic functionalities on the aromatic rings that make up the high molecular weight constituents thereby preventing or minimizing condensation or polymerization reactions. The use of ammonia gas in the above manner enables the viscosities of the bottoms streams to be controlled so the bottoms can be easily pumped and at the same time allows the conversion in the liquefaction reactor to be increased thereby producing more lower molecular weight liquid products.

Referring again to FIG. 1, the gaseous ammonia that is introduced into the bottom of distillation columns 23 and 33 through lines 18 and 19 respectively is normally obtained in the overall liquefaction process depicted in the figure by selectively processing the gaseous streams removed from separator 20 through line 21, distillate drum 25 through line 26 and distillate drum 35 through line 36. If the amount of ammonia so produced is insufficient, extraneous ammonia gas can be utilized. The amount of the ammonia needed will depend primarily on the viscosity desired in the bottoms stream removed from the distillation column. Normally, sufficient ammonia gas will be introduced into the columns such that the weight ratio of gas to column feed ranges between about 0.01 and about 0.6. The introduction of the ammonia into the distillation columns may also result in an increase in the amount of lighter liquid products produced during fractionation.

Although in the embodiment of the invention depicted in FIG. 1, the added ammonia gas is introduced directly into the distillation columns, it will be understood that the gaseous ammonia treatment can take place at different locations in the overall flow scheme. For example, instead of introducing the ammonia gas into atmospheric distillation column 23 through line 18, it could have been introduced into separator 20. Likewise, instead of introducing the ammonia into vacuum distillation column 33 through line 19, the bottoms stream in line 32 could have been passed into a holding tank and the bottoms treated with the added ammonia gas there. If this is done, the treatment will normally take place at atmospheric pressure and at a temperature between about 300° F. and about 700° F. for a period between about 5 minutes and about 24 hours. The feed stream to atmospheric distillation column 23 could be treated in a holding tank in the same manner prior to introducing the stream into the distillation column.

The heavy bottoms produced in vacuum distillation column 33 consists primarily of high molecular weight liquids boiling above a temperature between about 850° F. and about 1000° F., mineral matter or ash, and unconverted carbonaceous solids. This heavy bottoms stream contains a substantial amount of organic material and is normally further converted to recover additional hydrocarbon liquids and/or gases. The heavy bottoms can be subjected to a variety of conversion processes including partial oxidation, pyrolysis, gasification, extraction and combustion. In some cases, the bottoms withdrawn from the vacuum distillation column will not be sent directly to these conversion processes but will be passed into a holding or storage tank where they will be held for a certain period of time prior to further processing. In order to keep the bottoms in a molten state, they must be stored at a relatively high temperature, between about 300° F. and about 700° F. It has been found, however, that storage of the bottoms at such high temperatures for even a relatively short period of time, between about 0.5 and about 4.0 hours, results in a relatively large increase in viscosity. This increase in viscosity makes it extremely difficult to remove the bottoms from the storage facilities and pump them to the downstream processing units. It has been found that such viscosity increases can be substantially prevented during high temperature storage by treating the bottoms with ammonia gas.

Referring again to FIG. 1, the portion of the heavy bottoms stream removed from vacuum distillation column 33 through line 42 that is not recycled through lines 55 and 13 to slurry preparation zone 12 is passed through line 46 into storage tank or similar device 43. Here the bottoms are contacted with added ammonia gas introduced into storage tank 43 through line 44. The temperature in the storage tank will normally range between about 300° F. and about 700° F. while the pressure will normally be between about 0 psig and about 50 psig. Sufficient ammonia is introduced into the storage tank through line 44 to continuously blanket the bottoms in the tank as the bottoms are agitated with stirrer 57. The gaseous ammonia is removed overhead from the tank through line 56 and recycled through line 44. It is believed that the ammonia gas introduced into storage tank 43, like that introduced into distillation columns 23 and 33, reacts with acidic functionalities in the molecules comptising the organic portion of the heavy bottoms thereby preventing or minimizing polymerization, which results in large increases in viscosity. Because of the effect of the ammonia treat gas, the bottoms can be easily pumped from tank 43 through line 45 to downstream processing equipment where the organic material in the bottoms is converted into liquids and/or gases.

The liquid feed available for solvent hydrogenation includes liquid hydrocarbons composed primarily of constituents boiling in the 350° F. to 700° F. range recovered from atmospheric distillation column 23 through line 29 and heavier hydrocarbons in the 700° F. to 850° F. boiling range recovered from vacuum distillation column 33 through line 40. Only a portion of these potential hydrogenation reactor feed components, which are combined in line 41, are actually needed to produce the recycle solvent. The portion that is not needed for feed to the hydrogenation reactor is withdrawn as product through line 58. The remaining portion is heated to solvent hydrogenation temperature, mixed with hydrogen introduced into line 41 through line 47 and introduced into the hydrogenation reactor. The particular reactor shown in the drawing is a two-stage, down-flow unit including an initial stage 48 connected by line 49 to second stage 50, but other types of reactors can be used if desired.

The solvent hydrogenation reactor is preferably operated at about the same pressure as that in liquefaction reactor 16 and at a somewhat lower temperature. In general, temperatures within the range between about 550° F. and about 850° F., pressures between about 800 psig and about 3000 psig, and space velocities between about 0.3 and 3.0 lbs of feed/hr/lb of hydrogenation catalyst are employed in the hydrogenation reactor. It is generally preferred to maintain a mean hydrogenation temperature within the reactor between about 620° F. and 750° F. Any of a variety of conventional hydrotreating catalyst may be employed in the reactor. Such catalysts typically comprise an inert support carrying one or more iron group metals and one or more metals from Group VI-B of the Periodic Table of Elements in the form of an oxide or sulfide. Combinations of one or more Group VI-B metal oxide or sulfide are generally preferred. Representative metal combinations which may be employed in such catalysts include oxides and sulfides of cobalt-molybdenum, nickel-molybdenum, and the like.

The hydrogenated effluent from second stage 50 of the reactor is withdrawn through line 51 and passed into separator 52 from which an overhead stream containing hydrogen gas is withdrawn through line 53. This gas stream is at least partially recycled through line 15 for reintroduction with the feed slurry into liquefaction reactor 16. Hydrogenated liquid hydrocarbons are withdrawn from the separator through line 54 and recycled through line 11 for use as hydrogen-donor solvent in slurry preparation zone 12.

In the embodiment of the invention described above and shown in FIG. 1, coal and other carbonaceous solids are subjected to hydroconversion or liquefaction in the presence of molecular hydrogen and a hydrocarbon solvent to produce an effluent which is processed in such a manner that the viscosities of the bottoms streams produced are controlled. It will be understood that the process of the invention is not limited to the treatment of bottoms streams produced by hydroconverting or liquefying carbonaceous solids but is also applicable to the treatment of bottoms streams produced by hydroconverting heavy hydrocarbonaceous oils, petroleum residua and similar feeds. It will also be understood that the hydroconversion of such feeds does not necessarily have to be carried out in the presence of a hydrocarbon solvent. It should be noted that the bottoms streams produced in the hydroconversion of heavy hydrocarbonaceous oils and petroleum residua will normally contain little, if any, mineral matter as compared to bottoms produced in hydroconverting coal and similar solids. Even though these bottoms streams do not contain mineral matter, the process of the invention may be needed in order to control viscosity increases caused by the tendency of the high molecular weight constituents in the bottoms streams to polymerize or otherwise undergo degradation when subjected to relatively high temperatures.

The nature and objects of the invention are further illustrated by the results of laboratory tests which indicate that the viscosity of heavy bottoms derived from the liquefaction of a bituminous coal and a lignite can be kept from increasing significantly during storage at high temperatures by treating the bottoms with gaseous ammonia.

Approximatly 20 grams of a heavy bottoms produced from the liquefaction of Illinois No. 6 bituminous coal and a Texas lignite in a coal liquefaction pilot plant similar to that depicted in FIG. 1 (except no bottoms were recycled to the liquefaction zone when the bituminous coal was liquefied) was placed in a viscosity sample cell and heated to about 600° F. The bottoms used were similar to the material that would be withdrawn through line 42 from the vacuum fractionator 33 shown in FIG. 1. In one set of runs, gaseous nitrogen was passed over the sample in the cell while the bottoms were continuously stirred and the viscosity monitored. In another set of runs, gaseous ammonia was passed into the cell and over the sample at a rate between 0.2 and 0.6 grams per minute while the sample was stirred and the viscosity monitored over a period of time. The results of these tests are set forth in FIGS. 2 and 3.

Figure 2:
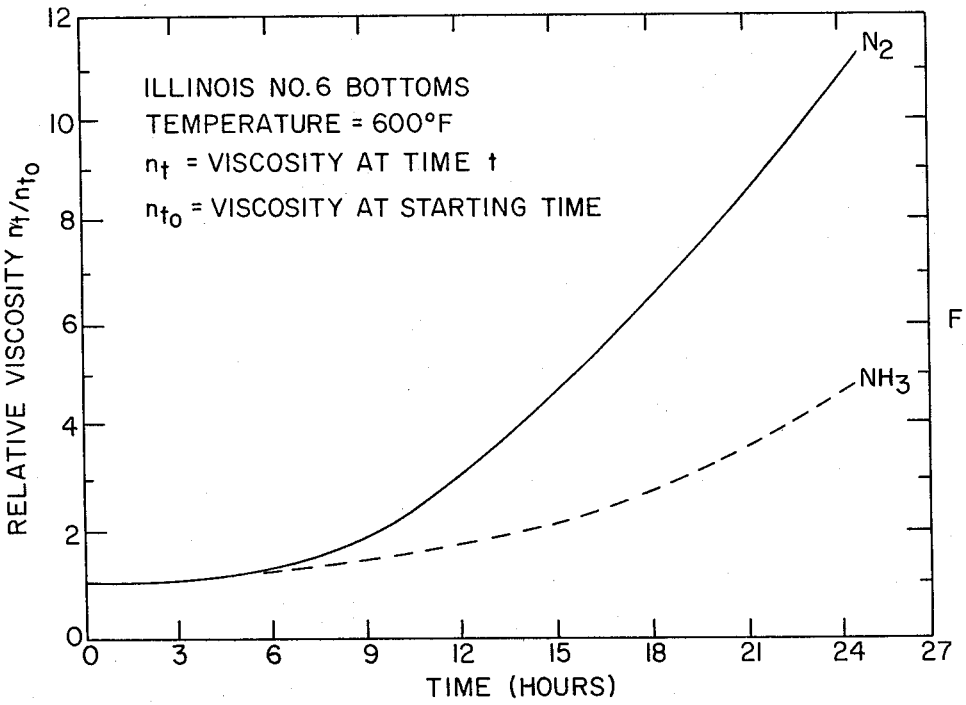
FIG. 2 is a plot illustrating that increases in the viscosity of bottoms produced by hydroconverting or liquefying a bituminous coal can be controlled during heat soaking by treatment with gaseous ammonia.
Figure 3:
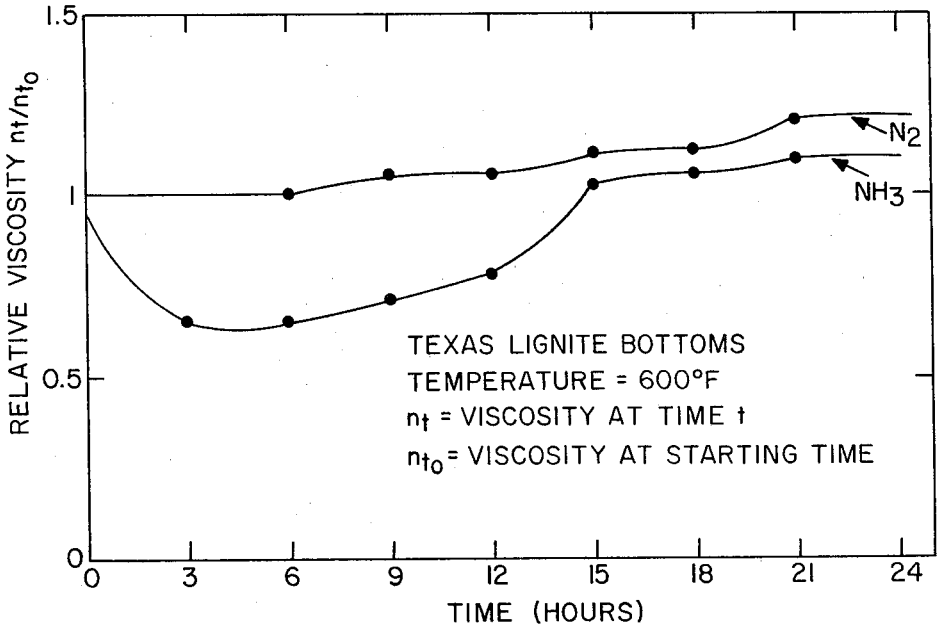
FIG. 3 is a plot illustrating that increases in the viscosity of bottoms produced by hydroconverting or liquefying a lignitic coal can be controlled during heat soaking by treatment with gaseous ammonia.

As can be seen from FIG. 2, the viscosity of the nitrogen-blanketed Illinois No. 6 bottoms sample began to rapidly increase after having been subjected to 600° F. for about 4 hours and eventually reached a value over ten times its initial viscosity at the end of a 24-hour period. The viscosity of the same bottoms treated with ammonia, on the other hand, began to increase only slightly after 4 hours and increased slowly thereafter to a value only a little over four times its original value after 24 hours of the heat treatment. FIG. 3 indicates that the viscosity of nitrogen-blanketed lignite bottoms began to increase slightly after about 6 hours of heat treatment; whereas the viscosity of the same bottoms treated with ammonia decreased for the first 6 hours and then increased. The increase in viscosity, however, never exceeded the viscosity of the nitrogen-treated bottoms over a 24 hour period. The data in FIGS. 2 and 3 clearly show that gaseous ammonia tends to reduce the increase in viscosity of heavy bottoms caused by high temperature heat treatment.

It will be apparent from the foregoing that the invention provides a process which is effective in preventing or minimizing viscosity increases in the heavy bottoms streams produced in the hydroconversion of coal and petroleum residuum thus insuring that the bottoms streams can be pumped from one processing unit to another. Furthermore, utilization of the process of the invention enables greater conversions to be achieved in the hydroconversion reactor and a resultant increase in liquid products.

We claim:

1. In a process for the hydroconversion of a carbonaceous feed in the presence of molecular hydrogen wherein a hydroconversion effluent containing liquids and unconverted carbonaceous material is produced, and said effluent is subjected to one or more separation steps to remove lower molecular weight liquids from said effluent and thereby produce a heavy bottoms stream containing high molecular weight liquids and unconverted carbonaceous material, the improvement which comprises contacting the feed stream to said separation step or steps at a temperature between about 300° F. and about 700° F. with sufficient added ammonia gas such that the weight ratio of said ammonia gas to said feed stream rangers between about 0.01 and about 0.6 prior to or during said separation step or said separation steps, thereby reducing and controlling the viscosity of said heavy bottoms stream.

2. A process as defined by claim 1 wherein said carbonaceous feed comprises carbonaceous solids and said solids are hydroconverted in the presence of molecular hydrogen and a hydrocarbon solvent.

3. A process as defined by claim 2 wherein said carbonaceous solids comprise coal.

4. A process as defined by claim 1 wherein said carbonaceous feed comprises petroleum residuum.

5. A process as defined by claim 1 wherein said separation step or steps comprise distillations.

6. A process as defined by claim 1 wherein said feed stream to said separation step or steps is contacted with said ammonia gas during said separation step or steps.

7. A process as defined by claim 1 wherein said effluent is subjected to an atmospheric distillation followed by a vacuum distillation.

8. A process as defined by claim 7 wherein said effluent is contacted with said added ammonia gas during said atmospheric distillation and the resultant bottoms is treated with said added ammonia gas during said vacuum distillation to produce said heavy bottoms stream.

9. A process as defined by claim 1 wherein said carbonaceous feed comprises petroleum residuum and said residuum is hydroconverted in the presence of molecular hydrogen and a hydrocarbon solvent.

10. A process as defined by claim 9 wherein said solvent comprises a nonhydrogen-donor solvent and said residuum is hydroconverted in the presence of an added catalyst.

11. A process for the liquefaction of coal which comprises:

(a) contacting said coal with a hydrocarbon solvent under liquefaction condition in the presence of molecular hydrogen in a liquefaction zone to produce a liquefaction effluent;

(b) separating said liquefaction effluent into a vapor stream and a slurry stream, said slurry stream comprising a high molecular weight fraction including mineral matter, heavy liquids and unconverted carbonaceous constituents, and a lower molecular weight liquid fraction;

(c) subjecting said slurry stream to an atmospheric distillation in the presence of added gaseous ammonia, thereby separating said slurry stream into one or more lower molecular weight liquid fractions and a higher molecular weight fraction containing said mineral matter, said heavy liquids and said unconverted carbonaceous constituents; and (d) subjecting said higher molecular weight fraction from step (c) to a vacuum distillation in the presence of added gaseous ammonia to produce a heavy bottoms stream having improved rheological properties and containing high molecular weight liquids, mineral matter, and unconverted carbonaceous constituents.

12. A process as defined by claim 11 wherein said hydrocarbon solvent comprises a hydrogen-donor solvent.

13. A process as defined by claim 11 wherein said solvent comprises a nonhydrogen-donor solvent and said liquefaction is carried out in the presence of an added catalyst.

14. A process as defined by claim 11 wherein said heavy bottoms stream produced in step (d) is contacted with added gaseous ammonia prior to being subjected to a subsequent processing step.

15. In a process for the hydroconversion of a carbonaceous feed in the presence of molecular hydrogen wherein a hydroconversion effluent containing liquids and unconverted carbonaceous material is produced, said effluent is subjected to one or more separation steps to remove lower molecular weight liquids from said effluent and thereby produce a heavy bottoms stream containing high molecular weight liquids and unconverted carbonaceous material, and said heavy bottoms is further processed to recover hydrocarbon values, the improvement which comprises contacting said heavy bottoms at a temperature above about 300° F. with added ammonia gas prior to said further processing.

16. A process as defined by claim 15 wherein said carbonaceous feed comprises coal and said coal is hydroconverted in the presence of molecular hydrogen and a hydrocarbon solvent.

17. A process as defined by claim 15 wherein said carbonaceous feed comprises petroleum residuum.

18. A process as defined by claim 15 wherein the feed stream to said separation step or steps is contacted with added ammonia gas prior to or during said separation step or steps.

19. A process as defined by claim 15 wherein said heavy bottoms is contacted with said added ammonia gas at a temperature between about 300° F. and about 700° F.

20. A process as defined by claim 15 wherein said effluent is subjected to an atmospheric distillation followed by a vacuum distillation.

21. A process as defined by claim 20 wherein the feed streams to said atmospheric distillation and said vacuum distillation steps are contacted with added ammonia gas during said distillations.

* * * * *